US006247406B1

(12) United States Patent
D'Annunzio et al.

(10) Patent No.: US 6,247,406 B1
(45) Date of Patent: Jun. 19, 2001

(54) PRINTING UNIT WITH MORE EASILY REMOVABLE COMPONENTS

(75) Inventors: Federico D'Annunzio, Cislago; Giacomo Maccalli, Lodi, both of (IT)

(73) Assignee: Gi Due S.r.l., Cislago (IT)

( * ) Notice: Subject to any disclaimer, the term of this patent is extended or adjusted under 35 U.S.C. 154(b) by 0 days.

(21) Appl. No.: 09/669,966

(22) Filed: Sep. 26, 2000

(30) Foreign Application Priority Data

Oct. 11, 1999 (EP) ..... 99830637

(51) Int. Cl.[7] ..... B41F 31/00

(52) U.S. Cl. ..... 101/479; 101/153; 101/216; 101/350.1; 101/477

(58) Field of Search ..... 101/477, 479, 101/216, 219, 174, 151, 152, 153, 157, 349.1, 350.1

(56) References Cited

U.S. PATENT DOCUMENTS

| | | | | |
|---|---|---|---|---|
| 4,019,434 | * | 4/1977 | Hoexter | 101/216 |
| 4,240,347 | * | 12/1980 | Hazelton et al. | 101/153 |
| 4,411,194 | * | 10/1983 | Davidson, Jr. | 101/216 |
| 4,901,641 | * | 2/1990 | Steiner et al. | 101/152 |
| 5,022,322 | * | 6/1991 | Keller | 101/350.1 |
| 5,101,726 | * | 4/1992 | Lübke et al. | 101/216 |
| 5,363,764 | * | 11/1994 | Horiguchi et al. | 101/477 |
| 5,528,986 | * | 6/1996 | Anderson et al. | 101/479 |
| 5,590,598 | * | 1/1997 | Keller | 101/479 |
| 5,806,427 | * | 9/1998 | Wiemiro et al. | 101/479 |
| 5,979,319 | * | 11/1999 | Hamaoka et al. | 101/350.1 |
| 6,050,190 | * | 4/2000 | Knauer et al. | 101/216 |
| 6,155,166 | * | 12/2000 | Bertagna et al. | 101/349.1 |

FOREIGN PATENT DOCUMENTS 0 741 025 11/1996 (EP) .

* cited by examiner

*Primary Examiner*—Eugene Eickholt
(74) *Attorney, Agent, or Firm*—Guido Modiano; Albert Josif; Daniel O'Byrne

(57) ABSTRACT

A printing unit with more easily removable components, comprising two outer shoulders, which are adapted to support a printing cylinder, and two inner shoulders, which are pivoted to the outer shoulders so as to pass from an open position to a closed active printing position, the pair of inner shoulders supporting an inking cylinder, a tray which is suitable to contain the ink and is arranged below the inking cylinder, and a cylinder bearing the type, the closure position of the two inner shoulders being such as to move the cylinder bearing the type into abutment against the printing cylinder in order to perform printing and such as to move the inking cylinder into abutment against the cylinder bearing the type.

12 Claims, 7 Drawing Sheets

PRINTING UNIT WITH MORE EASILY REMOVABLE COMPONENTS

BACKGROUND OF THE INVENTION

The present invention relates to a printing unit with more easily removable components. More particularly, the invention relates to a flexographic printing unit with more easily removable cylinders.

It is known that printing units, for example for flexographic printing, are provided with a plurality of printing cylinders: a first cylinder is an inking cylinder which dips into an ink tray in order to draw ink for printing; a second cylinder is a cylinder on which the print to be transferred to paper or another medium is provided; and a third cylinder is the actual printing cylinder, against which the cylinder that bears the type (anilox roller) abuts in order to perform printing on the paper. Finally, a fourth cylinder arranged downstream of the printing cylinder allows to transport the printed paper from one printing unit to a subsequent printing unit or to the outlet at the end of the printing cycle.

Printing units require considerable maintenance both as regards the cleaning to which the various cylinders must be subjected and as regards replacement of the cylinders, particularly the printing cylinder, whose diameter can vary according to the requirements of the users.

Conventional printing units provide for different technical solutions in order to access the various cylinders of the printing unit and therefore be able to remove them.

However, one drawback that is shared by all conventional solutions is the fact that access to the various cylinders, for example the inking cylinder, requires removing not only all the remaining cylinders of the printing unit but also parts of the printing unit itself, with a consequent considerable expenditure of time and difficulty in operation.

This situation worsens if the printing units are arranged in succession and replacement, for example removal of the inking cylinder due to a color change, which accordingly entails cleaning said cylinder, must be performed for each printing unit.

It is easily understandable that a removal operation for a single printing unit which requires a significant amount of time is multiplied by each printing unit that composes the printing machine.

SUMMARY OF THE INVENTION

The aim of the present invention is to provide a printing unit in which the various components of the printing unit can be removed independently of each other and without having to remove fixed parts of the printing unit.

Within the scope of this aim, an object of the present invention is to provide a printing unit in which removal of the various components of the printing unit can be performed in a very short time and without necessarily having to make contact with the printing cylinders and consequently getting dirty.

Another object of the present invention is to provide a printing unit in which the various components can be removed without the aid of particular tools.

Another object of the present invention is to provide a printing unit with more easily removable components which is highly reliable, relatively easy to manufacture and at competitive costs.

This aim, these objects and others which will become apparent hereinafter are achieved by a printing unit with more easily removable components, characterized in that it comprises two outer shoulders, which are adapted to support a printing cylinder, and two inner shoulders, which are pivoted to said outer shoulders so as to pass from an open position to a closed active printing position, said pair of inner shoulders supporting an inking cylinder, a tray which is suitable to contain the ink and is arranged below said inking cylinder, and a cylinder bearing the type, the closure position of said two inner shoulders being such as to move said cylinder bearing the type into abutment against said printing cylinder in order to perform printing and such as to move said inking cylinder into abutment against said cylinder bearing the type.

BRIEF DESCRIPTION OF THE DRAWINGS

Further characteristics and advantages of the present invention will become apparent from the description of a preferred but not exclusive embodiment of the printing unit according to the invention, illustrated only by way of non-limitative example in the accompanying drawings, wherein.

DESCRIPTION OF THE PREFERRED EMBODIMENTS

Figure 1:
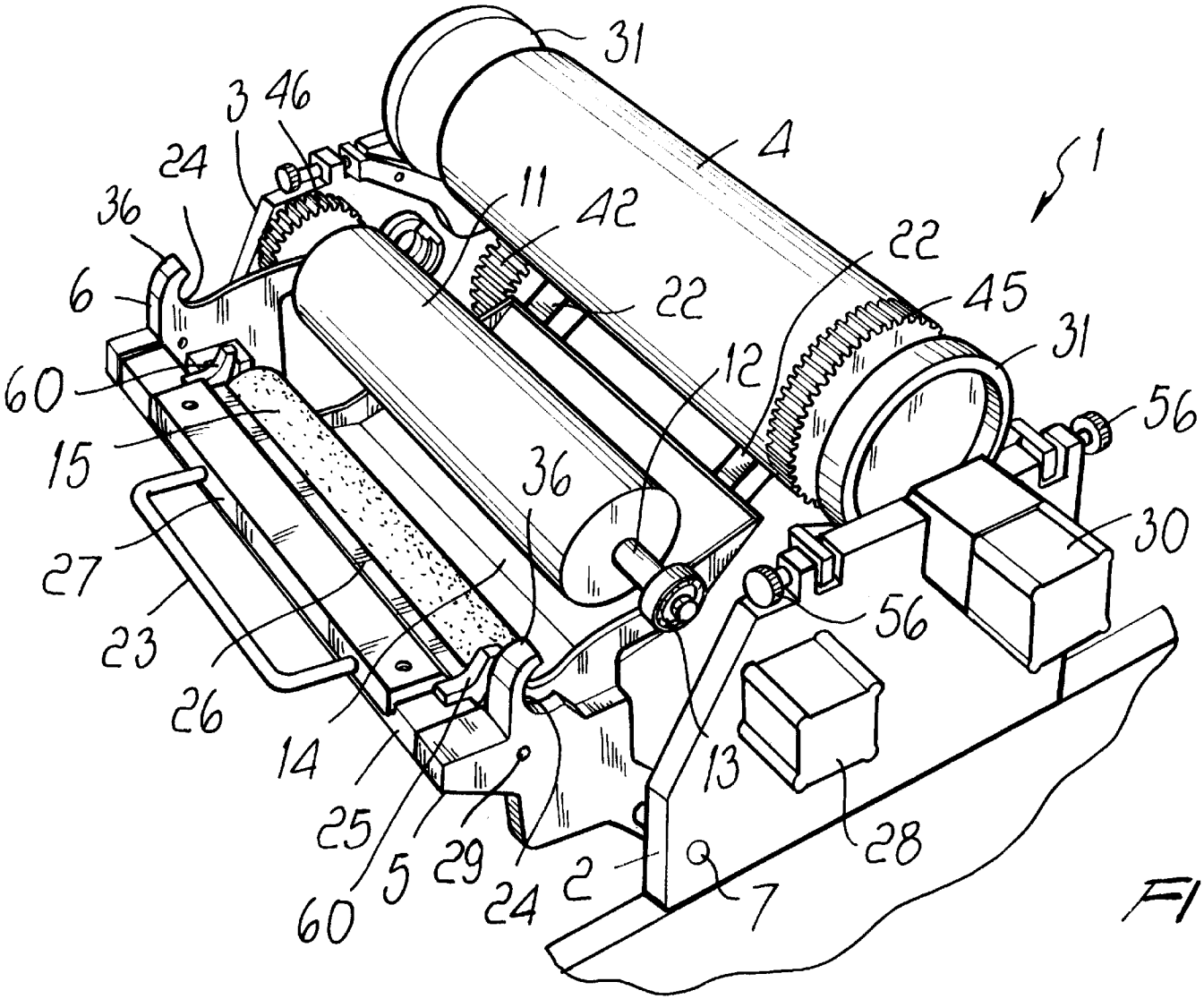
FIG. 1 is a perspective view of the printing unit according to the present invention.

With reference to the above figures, the printing unit according to the present invention, generally designated by the reference numeral 1, comprises two lateral shoulders 2 and 3 which form a supporting frame for a printing cylinder 4 and to which an additional pair of shoulders 5 and 6 is pivoted; said shoulders 5 and 6 are adapted to rotate about a rotation pivot 7 from an open position, in which complete access to the cylinders of the printing unit is allowed, as described in detail hereinafter, to a closed position, in which the various cylinders are in the working position for performing printing.

Each one of the two shoulders 5 and 6 is provided with an upper arm 9 which forms a first seat 10 for a cylinder 11 which bears the type for printing.

The cylinder 11 is seated by resting at each seat 10 of each arm 9 by means of two pivots 12 which protrude from the cylinder 11 and are provided with bearings 13. In this position, the cylinder 11 is inactive and the shoulders 5 and 6 are turned in the open position.

The cylinder 11 lies above a tray 14 which is adapted to contain the printing ink and in which an inking cylinder 15 dips; said inking cylinder is accommodated in a seat 16 formed at an intermediate region of the shoulders 5 and 6 respectively.

The cylinder 15 rests in the corresponding seat 16 by means of bearings 17, arranged so that there is one on each side.

The tray 14 is provided, in a downward region, with a seat 20 adapted to engage a pivot 21 which is formed at a lower end of the shoulders 5 and 6, so as to allow support of the tray 14, which abuts, with the end that lies furthest from the seat 20, against two arms 22 which are conveniently arranged at an angle in order to adapt to the shape of the tray 14.

The two shoulders 5 and 6 therefore allow, by pivoting on the pivots 7 of the shoulders 2 and 3, to perform an opening rotation of an entire portion of the printing unit, i.e., the portion constituted by the tray 14 and by the cylinders 11 and 15. The shoulders 5 and 6 are interconnected by means of a cross-member 25 on which a doctor 26 is fixed; said doctor is meant to remove the excess ink that deposits on the cylinder 11 following the contact of said cylinder with the inking cylinder 15 (during operation), which dips into the tray 14.

The doctor 26 is fixed to the cross-member 25 by means of a fixing element 27 (doctor and lateral cleaner supporting assembly), which has a handle 23 so as to allow its easy removal and comprises two cleaners 60 which are suitable to clean the lateral surface of the cylinder 11 from the ink.

The closure rotation of the two shoulders 5 and 6, performed about the two pivots 7 of the shoulders 2 and 3, moves the assembly constituted by the cylinder 11, the tray 14, the cylinder 15 and the doctor supporting assembly into the closure position and the shoulders 5 and 6 are locked by locking means 28, for example of the pneumatic type, which are rigidly coupled to the shoulders 2 and 3 and engage in appropriate holes 29 formed at the lateral surface of the shoulders 5 and 6.

In this way, the above-described portion of the printing unit is locked, keeping in the working position the cylinders 11 and 15 and the doctor and lateral cleaner supporting assembly.

Likewise, the printing cylinder 4 is locked in its seat by adapted locking means 30, for example of the pneumatic type, which engage a protruding annular element 31 which is arranged at each end of the printing cylinder 4.

The printing cylinder 4 is accommodated in an adapted seat 32 formed at an upper end of each one of the shoulders 2 and 3; accordingly, the removal of said cylinder is simplified, since it is sufficient to disengage the locking means 30 and then lift the printing cylinder 4 from the corresponding seat 32, gripping it for example by the annular elements arranged at its ends, therefore avoiding getting dirty.

Figure 2:
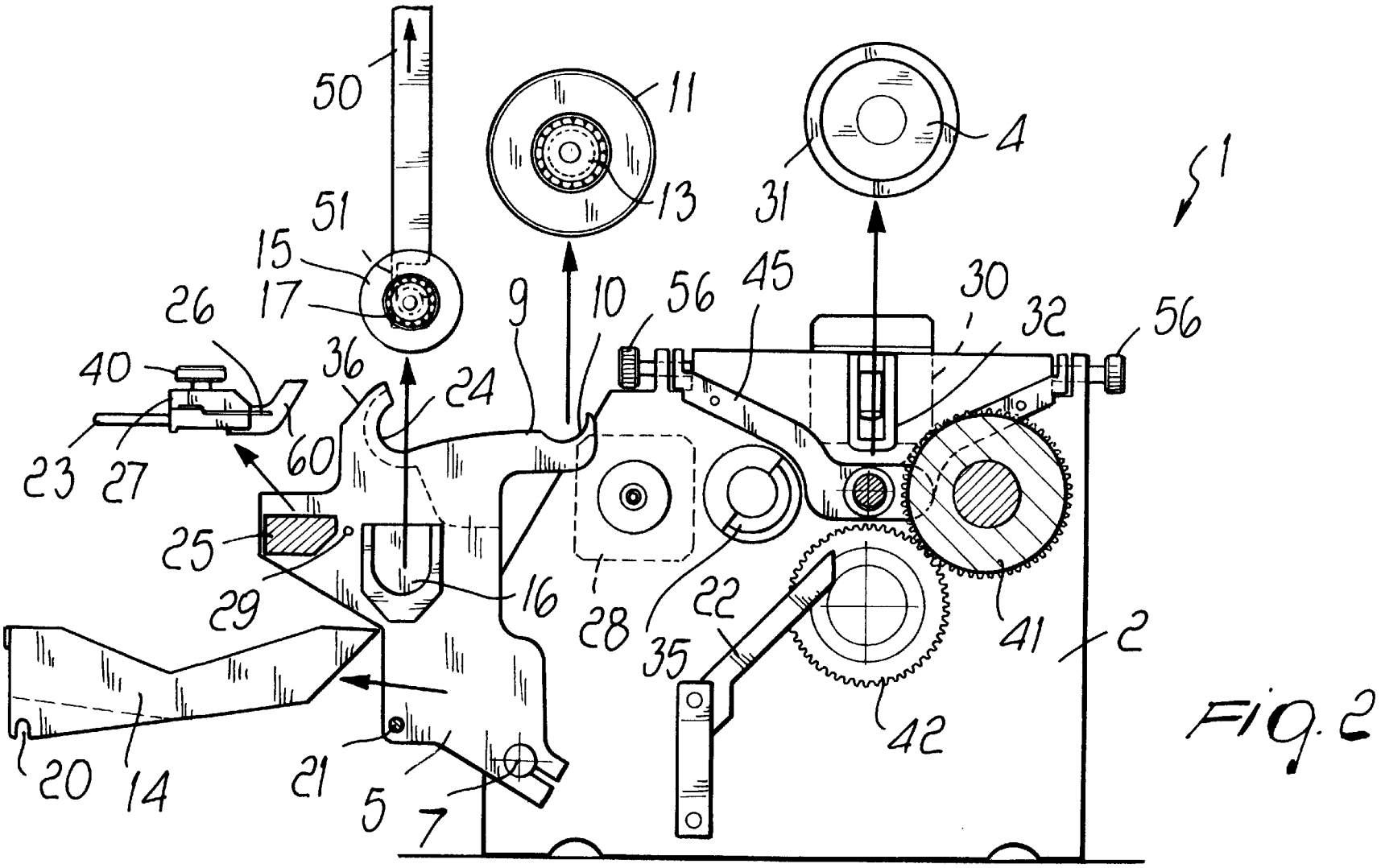
FIG. 2 is an exploded side view of the printing unit according to the present invention.
Figure 3:
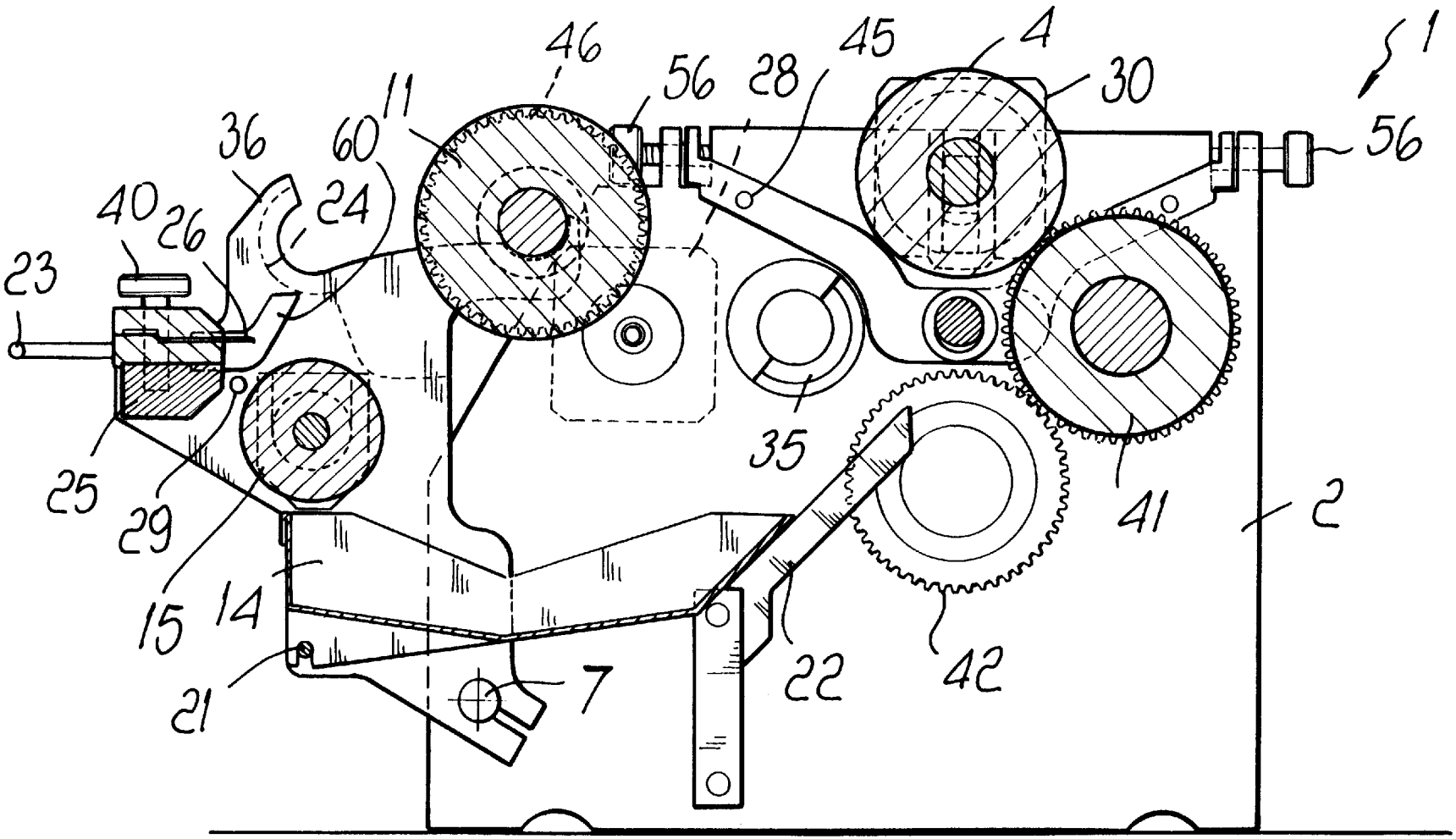
FIG. 3 is a partially sectional side view of the printing unit according to the present invention.
Figure 4:
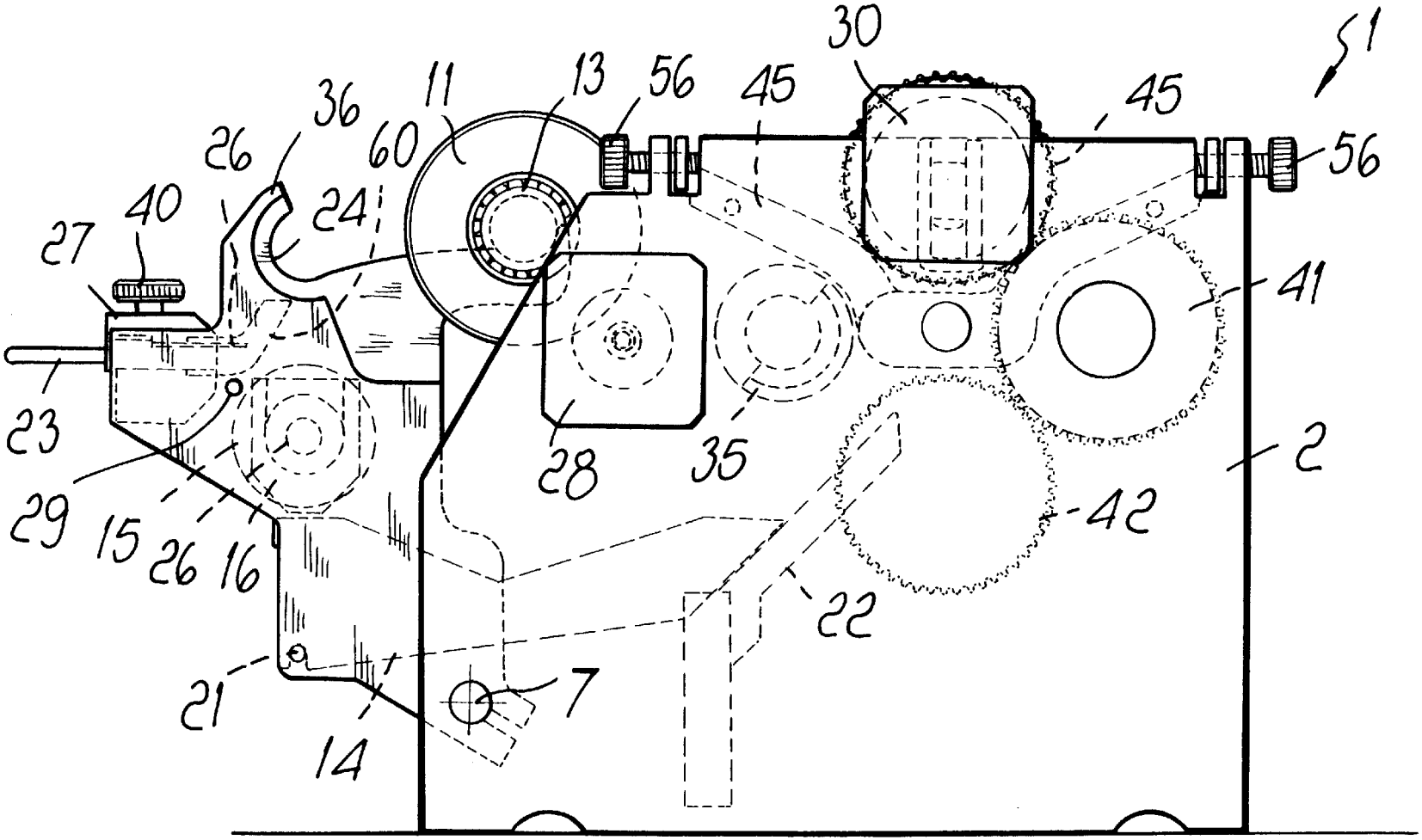
FIG. 4 is a side view of the printing unit according to the present invention, with some elements shown in dashed lines.
Figure 5:
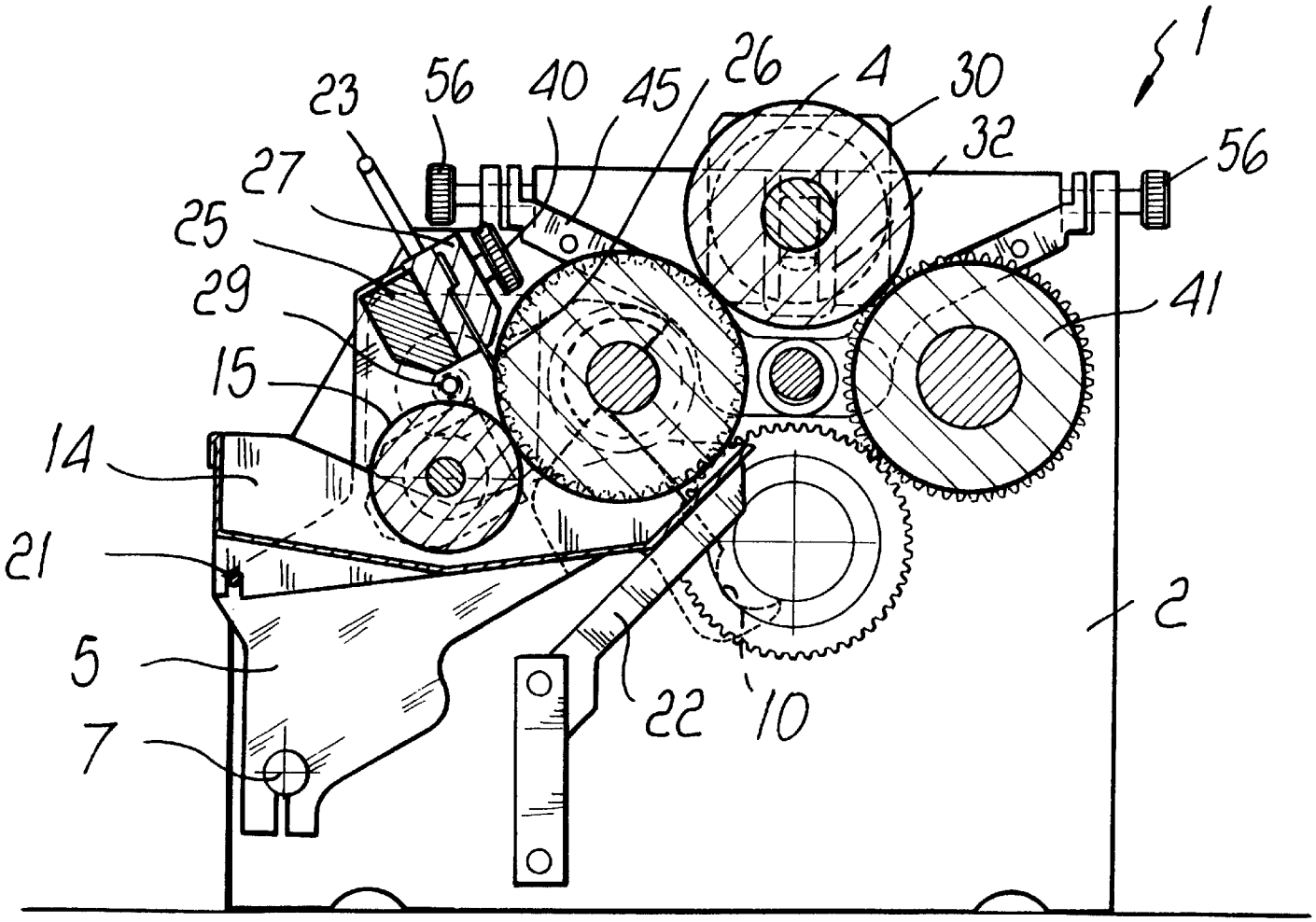
FIG. 5 is a partially sectional side view of the printing unit according to the invention, shown in the closed working position.

The closure rotation of the assembly formed by the cylinder 11, by the cylinder 15, by the tray 14 and by the doctor supporting assembly, rigidly connected by means of two shoulders 5 and 6, moves the bearings 13 of the roller 11 so that they engage suitable semicircular seats 35 formed at the internal surface of the shoulders 2 and 3, as shown for example in FIGS. 2, 3 and 4.

The second end of the arm 9, located opposite the end of the arm provided with the seat 10, has a C-shaped portion 36 which, when the two shoulders 5 and 6 are in the closure position, abuts against the seat 35, keeping the roller 11 locked in its seat. During closure, the roller 11 slides along the arm 9 until it is seated in a seat 24 of the arm 9 which is formed at the portion 36.

Conveniently, as shown in FIGS. 2, 3, 4 and 5, the means 27 for locking the doctor 26 are conveniently fixed to the cross-member 25 of the printing unit by means of two threaded pins which are provided with a knob 40 in an upward region.

During the closure movement, the doctor 26 is arranged at an appropriate fixed angle with respect to the cylinder 11 and the lateral cleaners 60 are arranged adjacent to the lateral surfaces of said cylinder.

Figure 6:
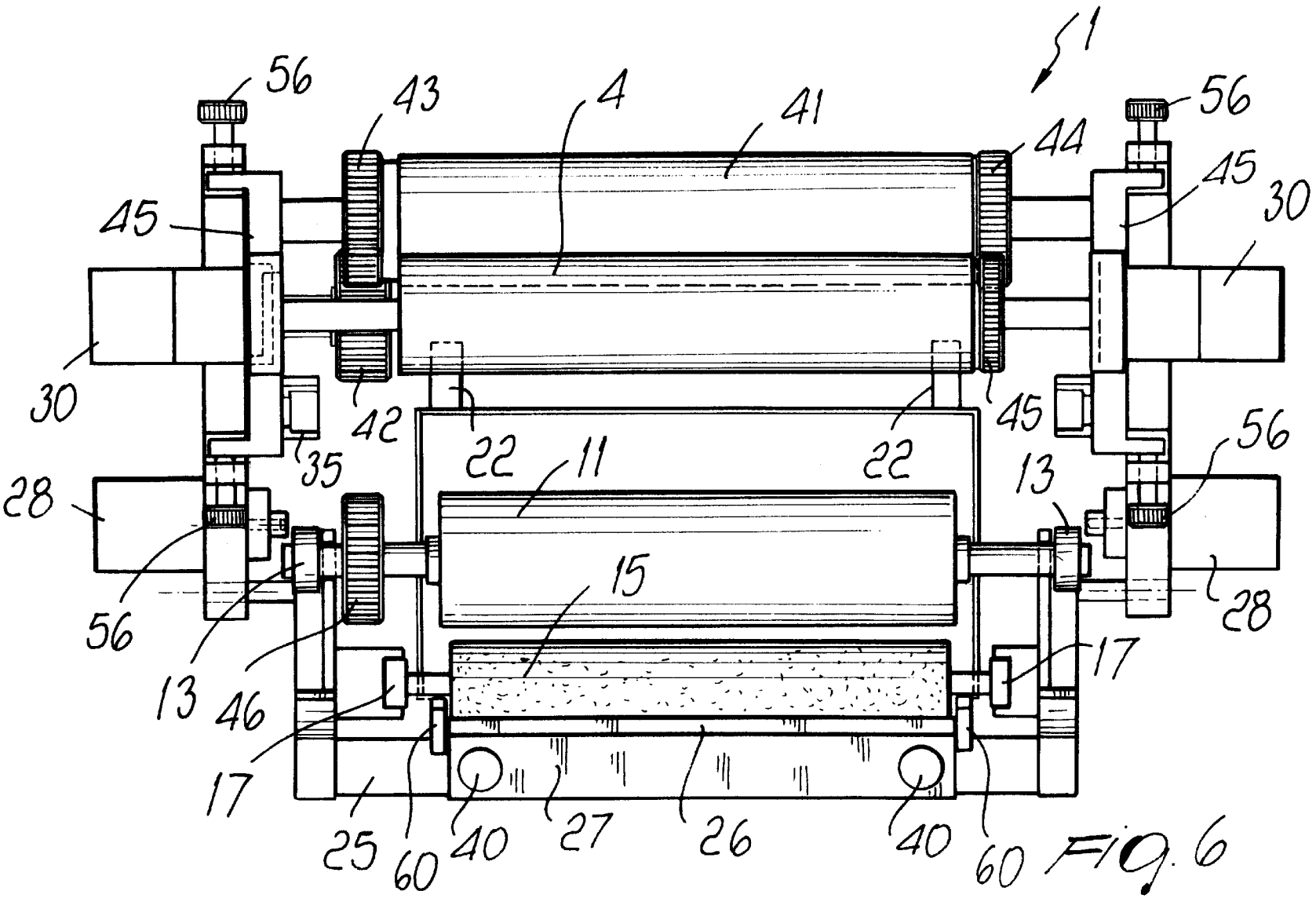
FIG. 6 is a top plan view of the printing unit according to the present invention.

FIG. 6 is a plan view of the printing unit according to the present invention, illustrating gears which actuate the various cylinders.

In particular it should be noted that FIG. 6 illustrates the printing unit in the open condition, in which the cylinder 11 is not in contact with the cylinder 4.

Opposite the cylinder 11 relative to the cylinder 4 there is provided an additional cylinder 41 which is meant to transport the printed paper.

A first gear 42 is directly connected to a motor (not shown) for driving the printing unit and engages a second gear 43 which is arranged externally with respect to the cylinder 41 and is rigidly coupled thereto. In turn, the cylinder 41 has a third gear 44 which is arranged at the opposite side with respect to the gear 43 and engages a fourth gear 45 which is rigidly coupled to the printing cylinder 4.

The gear 42 in turn engages a fifth gear 46, which is instead rigidly coupled to the cylinder 11.

The position of the printing cylinder 4 with respect to the footing of the printing unit is adjusted vertically and horizontally by position adjustment means 45 which are actuated by two screws 56.

In practice, the printing unit according to the invention allows, by way of its particular construction, to access the various components very easily, without having to disassemble fixed parts of the printing unit and most of all so as to allow to access each one of the components substantially independently.

Following the opening rotation of the two shoulders 5 and 6 (which, as mentioned, are pivoted by means of the pivot 7 to the shoulders 2 and 3 of the printing unit), the user can in fact open the printing unit, and therefore the cylinders 11 and 15 and the doctor supporting assembly, which are rigidly coupled to the shoulders 5 and 6, move away, with a rotary motion, from the printing cylinder 4 and from the transport cylinder 41.

In this manner it is possible to access the cylinders 11 and 15 and the doctor supporting assembly simply by removing the cylinder 11, lifting it from its seat 10, and then removing the inking cylinder 15, without having to disassemble parts of the machine and, by unscrewing the two knobs 40, removing the doctor supporting assembly.

Since the inking cylinder 15 is soaked with ink and is not easy to handle, it can be removed by means of a tool, shown in FIG. 2 and designated by the reference numeral 50, which comprises a transverse element with which two arms arranged at 90° are arranged, said arms being conveniently provided, at one end, with a hook-shaped portion 51 which allows to engage each end of the inking cylinder 15 in order to be able to lift it without getting dirty.

Likewise, removal of the doctor for cleaning or replacement can be performed rather simply by loosening the knobs 40 and lifting the locking element 27.

Also the ink tray can be removed independently of the other elements. The tray can be removed laterally or from above, so to speak, by simultaneously lifting the inking cylinder 15 and the tray 14 simply with one's hands or with the aid of a suitable gripping tool, similar to what has been described for the lifting of the cylinder 14. Grip is applied to the tray, which is accommodated in the appropriately provided seat during the lifting movement.

Figure 7:
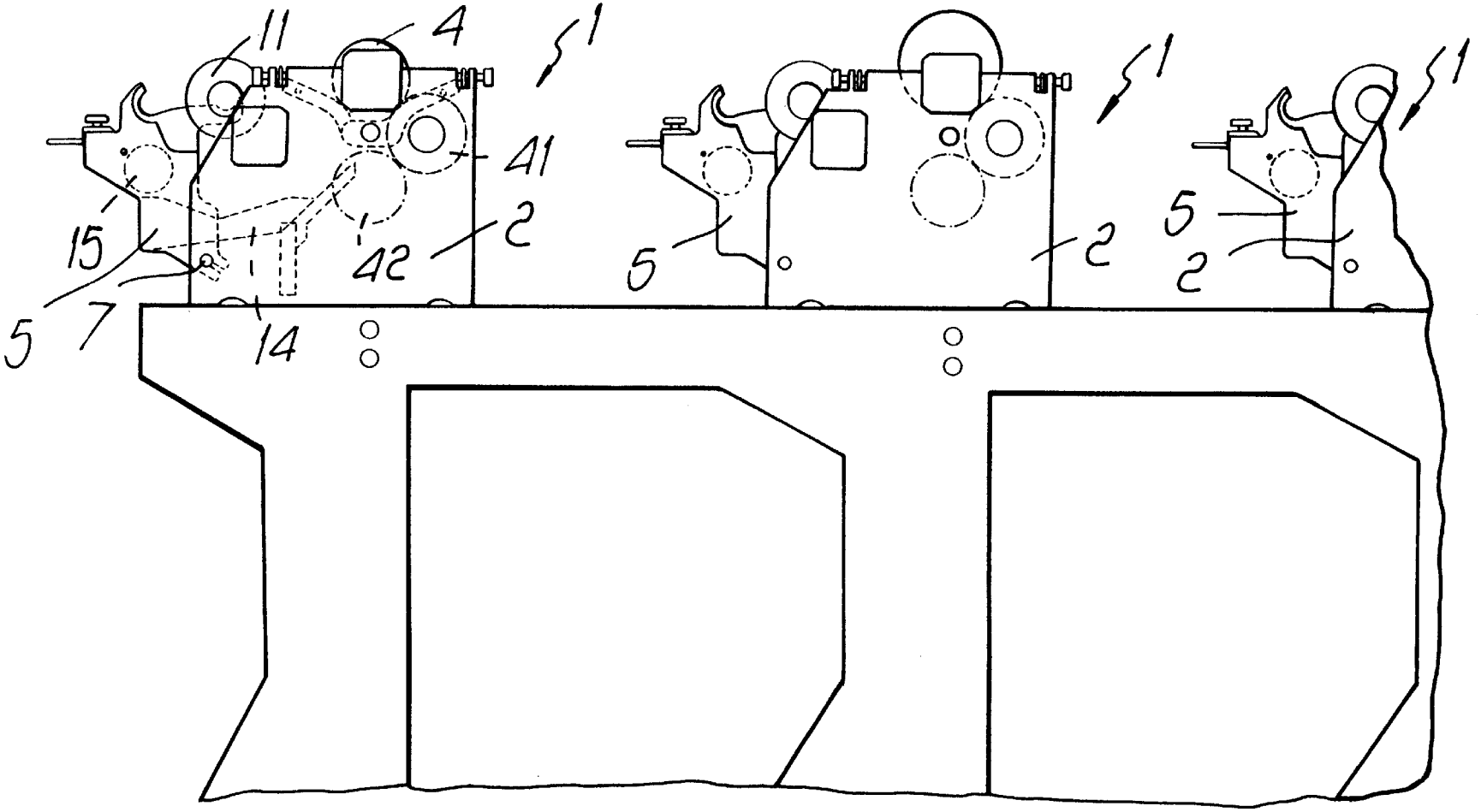
FIG. 7 is a side view of the series connection of a plurality of printing units according to the present invention.

In this manner it is evident that removal of the components of the printing unit, both for replacement and for maintenance thereof, can be performed very simply and rapidly, and this allows, for example in a case such as the one shown in FIG. 7, where a plurality of printing units are present, arranged in series with respect to each other, to perform the entire operation in a very short time, with consequent and evident advantages as regards the printing operation and therefore the costs of the printed end product.

In practice it has been observed that the printing unit according to the invention allows to provide a considerable improvement with respect to conventional printing units as regards operations for removing and mounting the components of the printing unit.

The printing unit thus conceived is susceptible of numerous modifications and variations, all of which are within the scope of the inventive concept; all the details may also be replaced with other technically equivalent elements.

In practice, the materials employed, so long as they are compatible with the specific use, as well as the dimensions, may be any according to requirements and to the state of the art.

The disclosures in European Patent Application No. 99830637.7 from which this application claims priority are incorporated herein by reference.

What is claimed is:

1. A printing unit with more easily removable components, comprising two outer shoulders, which are adapted to support a printing cylinder, and two inner shoulders, which are pivoted to said outer shoulders so as to pass from an open position to a closed active printing position, said pair of inner shoulders supporting an inking cylinder, a tray which is suitable to contain the ink and is arranged below said inking cylinder, and a cylinder bearing the type, the closure position of said two inner shoulders being such as to move said cylinder bearing the type into abutment against said printing cylinder in order to perform printing and such as to move said inking cylinder into abutment against said cylinder bearing the type.

2. The printing unit according to claim 1, wherein said pair of inner shoulders, pivoted to said pair of outer shoulders, is locked in the closure position by locking means.

3. The printing unit according to claim 1, wherein each one of said two inner shoulders comprises an arm which forms a first seat which is suitable to accommodate in said open position said cylinder bearing the type.

4. The printing unit according to claim 3, wherein said cylinder bearing the type is provided, at its ends, with two bearings which are suitable to engage in adapted seats formed on the internal surface of said two outer shoulders, when said two inner shoulders are in the closure position.

5. The printing unit according to claim 1, wherein said inking cylinder is accommodated in seats formed on an internal surface of said two inner shoulders.

6. The printing unit according to claim 1, wherein said tray suitable to contain the ink is supported by two pivots which are fixed at a lower end of said two inner shoulders, said tray being arranged in abutment, in the closure position, against two angled arms.

7. The printing unit according to claim 1, wherein said two inner shoulders are interconnected by a cross-member on which a locking element for a doctor is coupled, said doctor being arrangeable, in the closure position of said two inner shoulders, in close proximity to said cylinder bearing the type, in order to eliminate excess ink present on said cylinder bearing the type, said locking element supporting two lateral cleaners for said cylinder bearing the type.

8. The printing unit according to claim 1, wherein said printing cylinder is locked in position by locking means and in that the position of said printing cylinder can be adjusted by adjustment means.

9. The printing unit according to claim 1, wherein said inking cylinder is provided with two bearings at ends thereof, said inking cylinder being arranged, in the closed condition of said two inner shoulders, in abutment contact against said cylinder bearing the type.

10. The printing unit according to claim 4, wherein said two arms of said inner shoulders are provided with a second seat which is suitable to accommodate said cylinder bearing the type when said two inner shoulders are in the full closure position.

11. The printing unit according to claim 3, wherein said first seat of said two arms of said inner shoulders accommodates said cylinder bearing the type in an open position of said two inner shoulders with respect to said two outer shoulders.

12. The printing unit according to claim 10, wherein said second seat of each one of said arms of said two inner shoulders is C-shaped and suitable to abut against said seat formed on the internal surface of said two outer shoulders in the closure position of said two inner shoulders of said cylinder bearing the type.

* * * * *